US005632180A

United States Patent [19]

Doose

[11] Patent Number: 5,632,180

[45] Date of Patent: May 27, 1997

[54] METHOD OF AND APPARATUS FOR PRODUCING CORRUGATED SHEET WITH PLANE-PARALLEL OUTER EDGE SURFACES

[75] Inventor: Ingolf Doose, Stade, Germany

[73] Assignee: Umformtechnik Stade GmbH, Stade, Germany

[21] Appl. No.: 344,277

[22] Filed: Nov. 23, 1994

[30] Foreign Application Priority Data

Nov. 24, 1993 [DE] Germany ..... 43 39 962.2

[51] Int. Cl.[6] ..... B21D 13/02

[52] U.S. Cl. ..... 72/404; 72/379.6; 72/385

[58] Field of Search ..... 72/404, 414, 379.2, 72/309, 379.6, 385

[56] References Cited

U.S. PATENT DOCUMENTS

| | | | |
|---|---|---|---|
| 1,462,475 | 7/1923 | Atkinson | 72/404 |
| 2,753,918 | 7/1956 | Bradfield | 72/404 |
| 4,109,503 | 8/1978 | Francon | 72/379.6 |
| 4,819,473 | 4/1989 | Jansen | 72/404 |
| 5,333,482 | 8/1994 | Dunlap | 72/414 |

FOREIGN PATENT DOCUMENTS

| | | |
|---|---|---|
| 0072739 | 2/1983 | France . |
| 2029528 | 1/1971 | Germany . |
| 2332899 | 1/1975 | Germany . |
| 3610022A1 | 10/1987 | Germany . |
| 3610022 | 10/1987 | Germany . |

*Primary Examiner*—Daniel C. Crane
*Attorney, Agent, or Firm*—Herbert Dubno

[57] ABSTRACT

Corrugated sheet is produced by initially forming a corrugation running to the edge of the sheet between a pair of stamping dies or platens, whereupon at least at one end of the corrugation, end pieces with integrated cylinders displace respective rams to flatten the corrugation into the original plane of the workpiece to form plane parallel edge surfaces allowing straight edges of the sheet to be welded to adjacent sheets.

8 Claims, 3 Drawing Sheets

METHOD OF AND APPARATUS FOR PRODUCING CORRUGATED SHEET WITH PLANE-PARALLEL OUTER EDGE SURFACES

FIELD OF THE INVENTION

The present invention relates to a method of and to an apparatus for producing corrugated sheet with plane-parallel outer edge surfaces utilizing a hydraulic press or a mechanical press with platens or stamping tools shaped to provide the corrugations.

BACKGROUND OF THE INVENTION

German Patent Document 36 10 022 describes an apparatus which can be utilized to produce corrugated sheet having closed corrugations so that the lateral edge surfaces are plane-parallel and thus can be abutted along seams. The formation of such plane-parallel edge surfaces enables communication of the plates together along seams which are transverse in the direction in which the corrugations run. The seams can be welded or otherwise connected in abutting relationship, since the abutting edges of the sheet metal plates do not have any open spaces or hollows where corrugations might meet. The device does, however, have the disadvantage that the fabrication of closed corrugations, i.e. corrugations which do not run from one edge of the sheet to an opposite edge of the sheet is difficult technologically and expensive and the fabrication of tools which are capable of stamping closed-end corrugations from the sheet during the corrugation forming operation is extremely costly. In addition, the earlier technique has a tendency to reduce the thickness of the sheet metal in the regions of the closed end of the corrugations because of the excessive stretching of these ends necessitated by the deformation of the sheet to provide the closed end.

Other apparatus is known by means of which open end corrugations can be formed over the entire length or width of the sheet. The advantage of such an apparatus is that the corrugations can be formed with stamping tools which are relatively simple and, further, the sheet thickness tends to be constant in all regions of the corrugation. However, connection of corrugated sheet metal plates with the corrugations running to the connected edge is complicated and difficult. For example, the weld must meander along the contours of the meeting corrugations or open corrugations must be filled in. The closing of openings formed at the corrugations is expensive and time consuming.

OBJECTS OF THE INVENTION

It is, therefore, the principal object of the present invention to provide an improved apparatus for producing corrugated sheet whereby the aforedescribed drawbacks are avoided.

Another object of the invention is to provide an apparatus for making corrugated sheet which can be readily welded together but where excess thinning of the sheet metal because of closure of the corrugations can be avoided.

Still another object of the invention is to provide an improved apparatus for producing corrugated sheet which has the advantages of earlier systems without the disadvantages thereof to the greatest extent possible.

Still another object of the invention is to provide an improved method of making such sheet or operating the improved apparatus.

SUMMARY OF THE INVENTION

These objects and others which will become apparent hereinafter are attained, in accordance with the invention, with an apparatus wherein the stamping tools or dies of the hydraulic or mechanical press, i.e. the upper and lower press platens, shaped to provide throughgoing corrugations to the edge of the workpiece sheet or blank, are formed at their ends corresponding to the side at which the plane-parallel edge is to be formed, with stamping end pieces in which are integrated hydraulic or pneumatic cylinders with contouring rams movable relative to the movements of the movable stamping die or platen.

The invention provides, in addition, a process for producing corrugated metal sheet with plane parallel outer edge surfaces in a hydraulic or mechanical press wherein the open end corrugations are formed in the sheet between the stamping dies or pres platens and, while the workpiece is held between these platen or dies, the end of the corrugation which has been formed is flattened to lie in the original plane of the workpiece.

The invention has the advantage that corrugated sheet can be formed without flow of material from the region at which the corrugation is closed by the flattening operation, thereby precluding thinning of the sheet. Machining or other treatment of the sheet to produce the plane-parallel outer edge surfaces can be eliminated.

In particular, an apparatus for producing corrugated sheet with plane-parallel outer edge surfaces can comprise:

an upper and a lower press platen having mutually facing complementary formations for deforming a planar sheet workpiece to produce a corrugation therein extending over the workpiece to an edge thereof;

at least one main fluid-operated cylinder connected with one of the platens for displacing same to produce the corrugation; and respective end pieces on the platens in a region of the edge of the workpiece, the end pieces being formed with:

respective fluid-powered force-generating units, and respective shaping rams configured to define a contour of the corrugation in one relative position of the rams and the one of the platens during production of the corrugation and displaceable by the units relative to the one of the platens to flatten an end of the corrugation at the edge and impart a plane-parallel configuration to the region of the edge.

The rams can be movable in the same direction as the movable platen or stamping die to flatten the end of the corrugation. Alternatively, the rams can be movable in a direction opposite that of the movable platen or die.

Usually the upper platen will be movable against the stationary lower platen and the lower platen or die can be mounted on a stationary press table and the other upper platen can be movable and actuated by the main fluid operated cylinder, i.e. the hydraulic cylinder displacing the upper stamping die.

The end presses can be nonmovably connected with the pres platens.

The method of producing the corrugated sheet can comprise:

(a) pressing a planar sheet workpiece between an upper and a lower press platen having mutually facing complementary formations to deforming the sheet workpiece out of a plane thereof to produce a corrugation therein extending over the workpiece to an edge thereof; and (b) thereafter flattening an end of the corrugation at the edge into the plane to impart a plane-parallel configuration to a region of the edge.

The end of the corrugation may be flattened while the workpiece is fastened between the platens.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
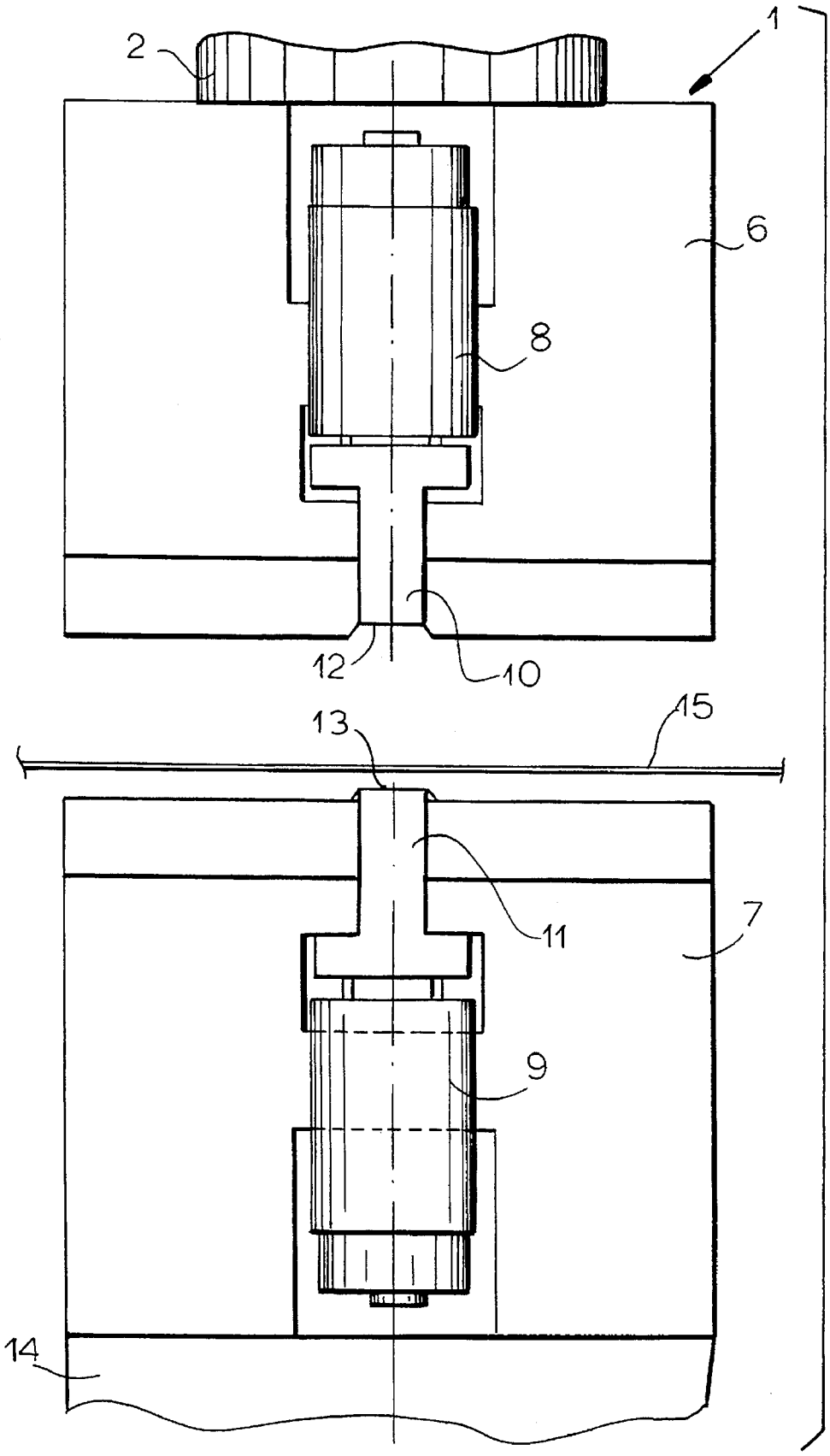
FIG. 1 is a schematic side elevational view of a press according to the present invention.
Figure 2:
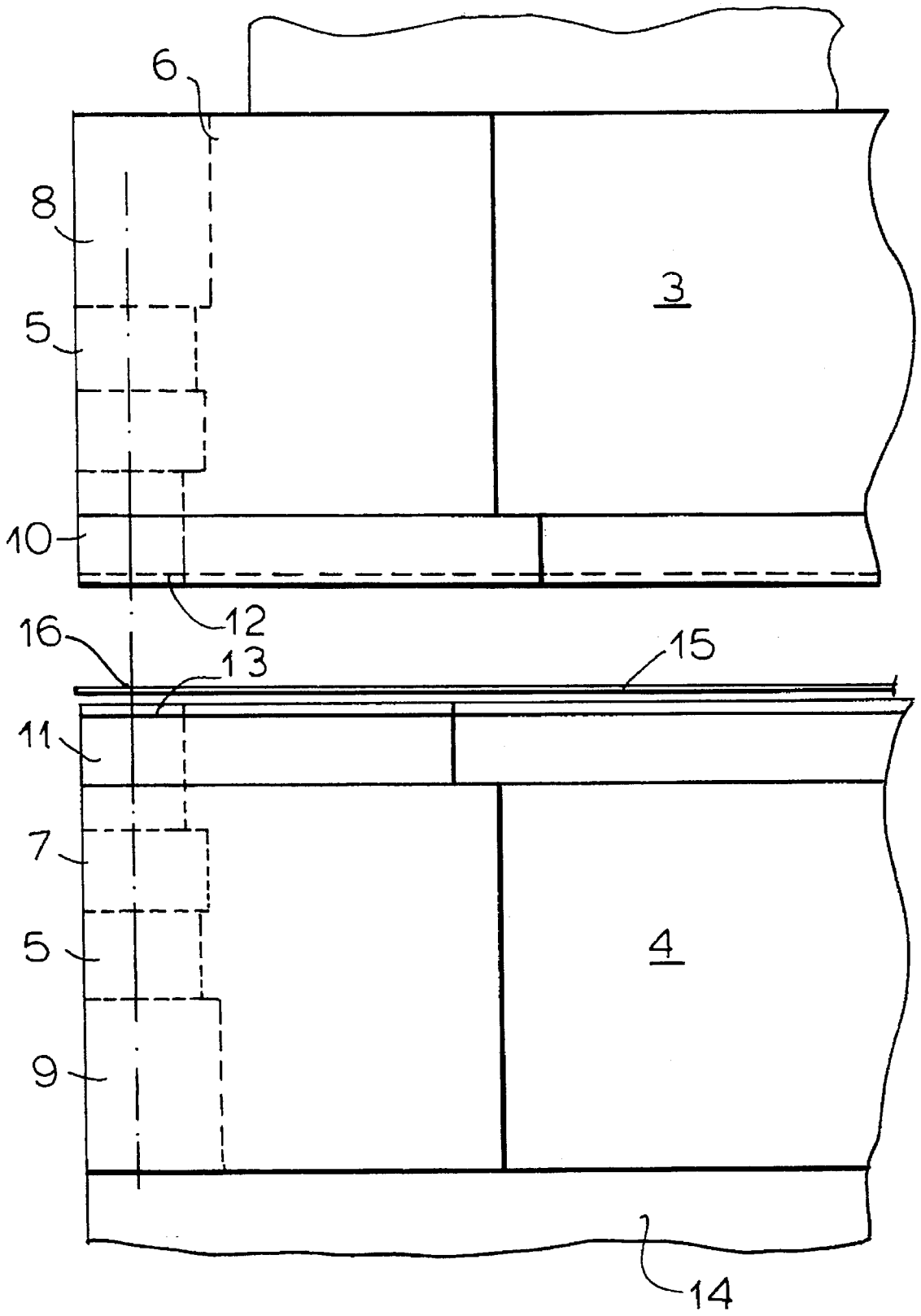
FIG. 2 is a schematic illustration of a portion of the pres of the invention seen in front view.

The apparatus shown in FIGS. 1 and 2 essentially comprises a hydraulic or mechanical press 1 with at least one hydraulic or pneumatic cylinder 2 (a main cylinder) and at least one upper stamping die or platen 3 and corresponding lower stamping die or platen 4 which are juxtaposed with one another and have on their confronting surfaces, configurations designed to form a corrugation with each down and up movement of the upper press platen or stamping die.

At the ends of the dies 3 and 4 corresponding to the end of the workpiece sheet to be provided with a plane-parallel edge surface, namely, the ends 5 in FIGS. 1 and 2, the stamping tools or platens are provided with an upper stamping end piece 6 and a lower stamping end piece 7. Integrated into the end pieces 6 and 7 are hydraulic or pneumatic cylinders 8, 9 which are equipped with shaping rams (contour rams) 10 and 11. The contour ram 10 in the upper end piece 3 defines the same contour 12 as the upper die or platen 3 while the contour ram 11 in the lower end piece 7 has the same configuration as the lower die or platen 4. The lower die or platen 4 is affixed to a stationary press table 14. The cylinders 8 and 9 are connected to a hydraulic or pneumatic unit for driving the respective rams.

Figure 3:
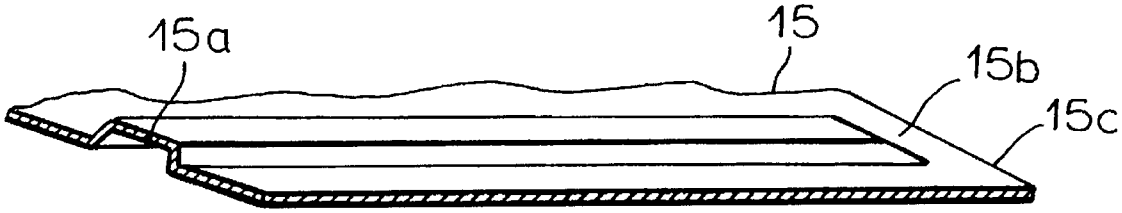
FIG. 3 is a perspective view showing a portion of a corrugated sheet with a plane-parallel edge region.

As can be seen from FIG. 3, a sheet metal workpiece 15 can be provided with a corrugation 15*a* of trapezoidal cross section and at the end of the corrugation, the region 15*b* can be deformed back into the plane of the workpiece sheet leaving a rectilinear edge 15*c* at a region adjoining this edge of plane parallel configuration that can be butt-welded to another sheet.

Figure 4:
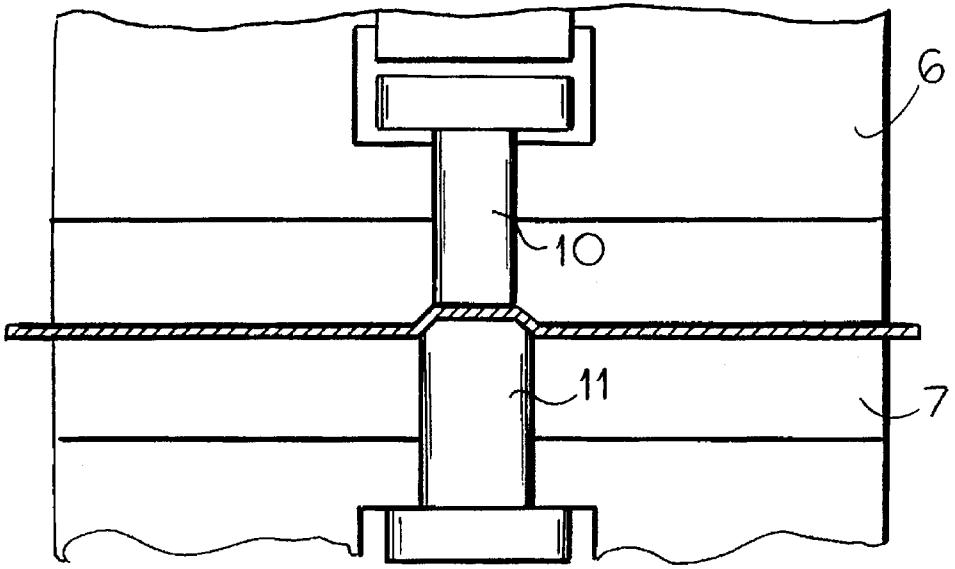
FIG. 4 is a diagram illustrating the end of the press forming the plane-parallel edge region during the initial formation of the corrugation.
Figure 5:
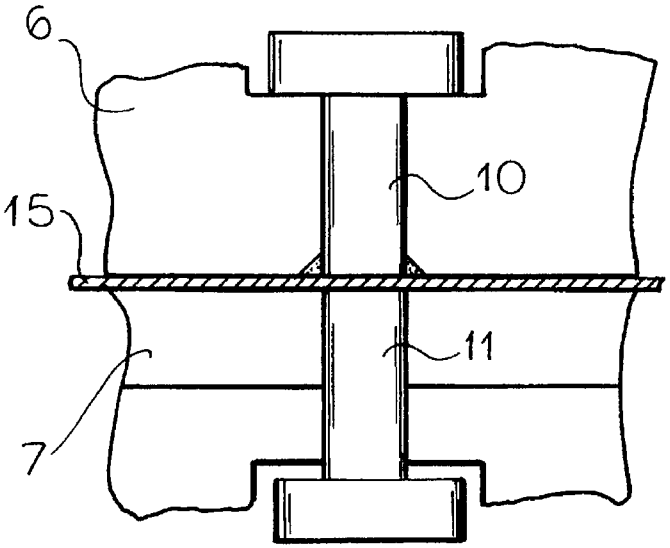
FIG. 5 is a view of the region shown in FIG. 4 illustrating the flattening back into the plane of the original workpiece sheet.

Referring to FIGS. 4 and 5 as well as to FIGS. 1–3 the fabrication of a corrugated sheet with plane-parallel outer edge surfaces can be effected as follows:

The workpiece sheet 15 is introduced between the upper stamping die or platen 3 and the lower stamping die or platen 4. The cylinder 8 in the upper end piece 6 is pressureless. The cylinder 9 in the lower end piece 7 is pressurized. During the downward movement of the platen or die 3, the sheet is stamped to form the corrugation. The rams 10 and 11 are then in their upper positions (FIG. 4). The press 1 is then stopped.

By a pulse to the hydraulic or pneumatic control unit, the cylinder 8 is pressurized and the pressure in cylinder 9 is relieved until the rams 10 and 11 move donwardly to deform the edge region back into the plane of the workpiece (FIG. 5) at the outer edge region 16. The press is then reversed and the upper platen or ram is raised so that the process can be repeated and additional corrugations formed on the sheet.

I claim:

1. An apparatus for producing corrugated sheet with plane-parallel outer edge surfaces, comprising:

an upper and a lower press platen having mutually facing complementary formations for deforming a planar sheet workpiece to produce a corrugation therein extending over said workpiece to an edge thereof;

at least one main fluid-operated cylinder connected with one of said platens for displacing same to produce said corrugation; and respective end pieces on said platens in a region of said edge of said workpiece, said end pieces being formed with:

respective fluid-powered force-generating units, and respective shaping rams configured to define a contour of said corrugation in one relative position of said rams and said one of said platens during production of said corrugation and displaceable by said units relative to said one of said platens to flatten an end of the corrugation at said edge and impart a plane-parallel configuration to said region of said edge.

2. The apparatus defined in claim 1 wherein said rams are moveable in the same direction as said one of said platens to flatten said end of said corrugation.

3. The apparatus defined in claim 1 wherein said rams are moveable in a direction opposite that of said one of said platens to flatten said end of said corrugation.

4. The apparatus defined in claim 1 wherein said lower platen is mounted on a stationary press table of a press and said upper platen is moveable and is actuated by said main fluid-operated cylinder.

5. The apparatus defined in claim 1 wherein said end pieces are nonmovably connected with said platens.

6. The apparatus defined in claim 1 wherein said rams have contours corresponding to those of the respective platens.

7. A method of producing corrugated sheet with plane-parallel outer edge surfaces, comprising the steps of:

(a) pressing a planar sheet workpiece between an upper and a lower press platen having mutually facing complementary formations to deform the sheet workpiece out of a plane thereof to produce a corrugation therein extending over said workpiece to an edge thereof; and (b) thereafter flattening an end of the corrugation at said edge by pressing said end of the corrugation back into said plane to impart a plane-parallel configuration to a region of said edge.

8. A method of producing corrugated sheet with plane-parallel outer edge surfaces, comprising the steps of:

(a) pressing a planar sheet workpiece between an upper and a lower press platen having mutually facing complementary formations to deform the sheet workpiece out of a plane thereof to produce a corrugation therein extending over said workpiece to an edge thereof; and (b) thereafter flattening an end of the corrugation at said edge into said plane to impart a plane-parallel configuration to a region of said edge while said workpiece is clamped between said platens.

* * * * *